US008180571B2

(12) United States Patent
Holmes

(10) Patent No.: US 8,180,571 B2
(45) Date of Patent: May 15, 2012

(54) WELLBORE SURVEYING

(75) Inventor: Anne Holmes, Cheltenham (GB)

(73) Assignee: Halliburton Energy Services, Inc., Houston, TX (US)

( * ) Notice: Subject to any disclaimer, the term of this patent is extended or adjusted under 35 U.S.C. 154(b) by 743 days.

(21) Appl. No.: 11/570,842

(22) PCT Filed: Jun. 21, 2005

(86) PCT No.: PCT/GB2005/002446

§ 371 (c)(1),
(2), (4) Date: Sep. 8, 2008

(87) PCT Pub. No.: WO2005/124102

PCT Pub. Date: Dec. 29, 2005

(65) Prior Publication Data

US 2009/0037110 A1 Feb. 5, 2009

(30) Foreign Application Priority Data

Jun. 21, 2004 (GB) ..... 0413934.1

(51) Int. Cl.
*G01V 3/18* (2006.01)

(52) U.S. Cl. ..... 702/9; 702/10; 324/346

(58) Field of Classification Search ..... 702/9, 10, 702/154; 324/346, 351; 73/152.46
See application file for complete search history.

(56) References Cited

U.S. PATENT DOCUMENTS 5,435,069 A 7/1995 Nicholson
2006/0238202 A1 * 10/2006 Gorek et al. ..... 324/373

FOREIGN PATENT DOCUMENTS

GB 2 158 587 A 11/1985
GB 2158587 A * 11/1985
WO WO 02/50400 A3 6/2002

OTHER PUBLICATIONS

Examination Report of the United Kingdom Patent Office dated May 21, 2008 on UK equivalent case Appl. No. GB0413934.1.
Office Action for Canadian Application No. 2,570,080, Jun. 15, 2010 (2 p.).
Response to Office Action for Canadian Application No. 2,570,080, Dec. 15, 2010 (6 p.).
Response to Examination Report of May 21, 2008 in United Kingdom Patent Application No. 0413934.1.

* cited by examiner

*Primary Examiner* — Manuel L Barbee
(74) *Attorney, Agent, or Firm* — Mark E. Scott; Conley Rose, P.C.

(57) ABSTRACT

This invention relates to surveying wellbores. In particular this invention provides methods of correcting magnetic surveys for the effects introduced by magnetic mud. The method of the present invention comprises, in broad terms, measuring gravitational and magnetic fields at least one position in the wellbore; comparing the measured fields with theoretical values, and introducing scale factors to adapt the measured values to equal the theoretical values thus making it possible to cope with the effects of magnetic mud.

30 Claims, 3 Drawing Sheets

WELLBORE SURVEYING

This application claims the priority and benefit of PCT/GB2005/002446 filed Jun. 21, 2005, which in turn claims priority to GB 0413934.1 filed Jun. 21, 2004.

The present invention relates to wellbore surveying, and more particularly, relates to measurement while drilling surveys using magnetic and gravitational vectors. The invention particularly relates to measurement while drilling surveys when the wellbore is being drilled with magnetic mud.

Measurement while drilling (MWD) surveys are carried out by making downhole measurements of the earth's gravitational and magnetic vector. The earth's magnetic field is generally defined in terms of its components in the coordinate system of the survey tool. The central axis running longitudinally along the tool is designated the z-axis. Perpendicular to one another and also to the z-axis are the x- and y-axes.

In view of the fact that the magnetic field along the axis of the wellbore is frequently corrupted, primarily due to the presence of magnetic materials in the drill string, MWD surveys commonly take measurements of the earth's gravitational vector and only the cross-axial components of the magnetic field (U.S. Pat. No. 4,510,696). This system involves determining the inclination and highside angles by measuring the gravity vector at the instrument, and determining the magnetic field along the axis of the borehole by minimising the difference between the true value of the earth's magnetic field and the tool measured value of the earth's magnetic field, resulting in more accurate azimuth angle calculations.

WO 02/50400 describes a method for determining magnetometer errors during a wellbore survey, in order to obtain an azimuth relative to true North. The method involves correcting for bias errors in magnetometer measurements of the earth's magnetic field which may be caused by magnetization of ferromagnetic portions of the drillstring.

GB 2 158 587 describes a method for the correction of errors in azimuth determination resulting from variations in the earth's magnetic field, specifically those variations caused by the drillstring.

Magnetization of the collar results in a cross-axial interference, which is indistinguishable from a cross-axial bias. U.S. Pat. No. 5,806,194 discloses a method to deal with this type of interference, which involves using a number of measurements and measuring locations. Variations in the measurements are used to estimate the cross-axial interference, which gives an improved estimate of the azimuth angle.

The above and other prior art methods rely on measurement of geomagnetic field data indicative of the direction and intensity of the geomagnetic field in the area of the borehole. Such methods do not take into account local crustal anomalies and time dependent variations in the earth's geomagnetic field.

U.S. Pat. No. 6,021,577 describes a method whereby spot measurements of the earth's geomagnetic field are taken at local measurement sites in the proximity of the wellbore, during drilling. The sites are sufficiently close for the data to be indicative of the geomagnetic field at the wellbore itself, but sufficiently distant such that the results are not affected by the magnetic interference caused by the drilling machinery and other installations. This method is known as Interpolated In-Field Referencing (IIFR).

The industry has recently started using drilling muds which contain a high content of magnetic materials, such as magnetite, ilmenite with iron impurities, or hematite with iron impurities. It is well known that when a magnetic mud surrounds a surveying tool, the cross-axial component of the magnetic field, as measured by the survey tool, is reduced (see, e.g. Electromagnetic Theory, Julius Adams Stratton, McGraw Hill Book Company, New York, 1941, page 265). The reduction in the cross-axial component of the magnetic field can result in significant surveying errors.

This screening of the field also changes the magnetic dip angle, δ. The magnetic dip angle, δ, is given by:

$$\delta = \sin^{-1}\left(\frac{\vec{B}\cdot\vec{g}}{B\cdot g}\right)$$

Where: $\vec{B}$ is the magnetic field vector; $B=|\vec{B}|$;

$\vec{g}$ is the gravitational field vector; $g=|\vec{g}|$;

and where the component of $\vec{B}$ along the tool axis is estimated by using the magnitude of the cross-axial field and the total field magnitude, obtained using either the standard model to calculate the Earth's magnetic field for a specified location, IFR (in-field referencing) or IIFR (interpolated in-field referencing—U.S. Pat. No. 6,021,577).

Since the measured cross-axial field magnitude is in error, the calculated dip angle is also in error. This leads to surveying errors. As with the magnitude of the magnetic field, the magnetic dip angle, in situ, can be estimated using, for example, standard global geomagnetic model, IFR or IIFR.

The prior art methods of overcoming cross axial interference have not been able to cope with the effects of magnetic mud. Accordingly, it is an object of the present invention to provide a method for reducing or overcoming the limitations of the prior art, and specifically, to provide a method of MWD which corrects for the effects introduced by magnetic mud.

In broad terms, the present invention provides a method of correcting magnetic surveys for the effects introduced by magnetic mud. The invention enables the detection and correction of the shielding effect of the magnetic mud.

According to a first aspect of the present invention there is provided a method of surveying a wellbore containing magnetic mud, comprising the steps of: obtaining theoretical data regarding the field strength and dip angle of the earth's magnetic field in the proximity of the wellbore; obtaining measured data from at least one station within the wellbore using at least one set of magnetometers and at least one set of accelerometers positioned in the wellbore; and, applying a correction to the measured data to correct the survey for the shielding effect of the magnetic mud.

The method of the present invention comprises, in broad terms, measuring gravitational and magnetic fields at least one station in the wellbore; comparing the measured fields with theoretical values, and introducing scale factors to adapt the measured values to equal the theoretical values thus making it possible to cope with the effects of magnetic mud.

Preferably the theoretical values of the earth's magnetic field are obtained from a location remote from the wellbore. Preferably the theoretical values are obtained using IFR or IIFR.

The method comprises the steps of calculating the highside angle and the inclination angle. Preferably, the highside angle is calculated from the accelerometer output using:

$$hsg = \tan^{-1}\left(\frac{gy}{-gx}\right)$$

wherein hsg is the highside angle, and gx and gy are the accelerometer outputs on the x and y axis respectively.

Preferably the inclination angle is calculated from the accelerometer output using:

$$inc = \tan^{-1}\left(\frac{(gx^2 + gy^2)^{0.5}}{gz}\right)$$

wherein inc is the inclination angle, and gx, gy and gz are the accelerometer outputs on the x, y and z axes respectively.

The invention comprises two important embodiments.

In a first embodiment the method uses data obtained from multiple stations at varying highside angles to determine the biases and scale factors of the three orthogonal downhole magnetometers, and it uses these errors to correct the tool measurements. This is an iterative technique that models the sensitivity of all the error sources as functions of highside, inclination and azimuth.

The method of this embodiment comprises obtaining data from a plurality of stations downhole. Preferably data is obtained from at least 5 stations. More preferably, data is obtained from 10 stations. It is to be understood that the higher the number of stations from which data is obtained, the greater the accuracy of the MWD survey. The highside angle at each station will differ.

At each station data is preferably obtained from at least one set of magnetometers and at least one set of accelerometers. Preferably each set of magnetometers comprises three magnetometers and each set of accelerometers comprises three accelerometers.

The magnetometer output measurements preferably comprise $Bx_m$, $By_m$ and $Bz_m$, wherein $Bx_m$, $By_m$ and $Bz_m$ are the values of the downhole magnetometer on the Preferably the method further comprises the steps of: correcting the measured magnetometer outputs $Bx_m$, $By_m$ and $Bz_m$ for magnetic interference/biases and shielding effects of mud using:

$$Bx_c = \frac{Bx_m}{1 - Sx} + \Delta Bx$$

$$By_c = \frac{By_m}{1 - Sy} + \Delta By$$

$$Bz_c = Bz_m + \Delta Bz$$

wherein $Bx_c$, $By_c$ and $Bz_c$ are magnetometer outputs corrected for biases and scaling errors, ΔBx, ΔBy and ΔBz are the magnetometer biases on the x, y and z axes respectively, and Sx, Sy are the magnetometer scaling errors on the x and y axes respectively.

The method of this embodiment may further comprise the step of calculating the measured dip angle. Preferably the measured dip angle is calculated using the vertical and horizontal components of the earth's field as follows:

$$Bv = -Bx_c \cdot \cos(hsg) \cdot \sin(inc) + By_c \cdot \sin(hsg) \cdot \sin(inc) + Bz_c \cdot \cos(inc)$$

$$Bn = \sqrt{(Bx_c^2 + By_c^2 + Bz_c^2)^{1/2} - Bv^2}$$

$$dip = \tan^{-1}\left(\frac{Bv}{Bn}\right)$$

wherein Bv is the vertical component of the earth's magnetic field; Bn is the horizontal component of the earth's magnetic field; dip is the tool measured dip angle.

The method may further comprise the step of calculating the total field, Bt. Preferably Bt is calculated using:

$$Bt = \sqrt{(Bx^2 + By^2 + Bz^2)}$$

The method may further comprise the step of using the calculated values of Bt and dip to minimise S. This step may be performed by the "least squares method". This step preferably comprises inputting Be, Bt, dipe and dip into the following algorithm:

$$S = \sum_n \left[\left(\frac{Be - Bt}{Be}\right)^2 + \left(\frac{dipe - dip}{dipe}\right)^2\right]$$

wherein Be and dipe are theoretical values of the earth's magnetic field strength and dip angle respectively, and Bt and dip are as hereinbefore defined; and, varying Sx, Sy, ΔBx, ΔBy and ΔBz in order to minimise S.

In the second embodiment of the present invention, it is assumed that the scale factor errors for both of the components of the cross-axial magnetic field (i.e. on the x- and y-axes) are the same. This method is particularly useful where there is a limited amount of data, and it allows for the scale factor error to change at different survey stations.

In one embodiment, this method effectively uses the "short collar corrections method" (SCC, U.S. Pat. No. 4,510,696) to determine axial interference. The difference between the magnetic dip angle corrected for axial interference and the theoretical dip angle is minimized by modifying the cross-axial field components (Bx and By) by a common scale factor.

The method of this embodiment comprises obtaining accelerometer output and magnetometer output measurements from at least 1 position in the wellbore.

The highside and inclination angles are then calculated as heretofore described, and the azimuth is calculated, preferably by the short collar correction method (azSCC).

The method may further comprise the step of calculating $Bz_c$. Preferably $Bz_c$ is calculated using:

$$Bz_c = Be \cdot \cos(dipe) \cdot \sin(inc) \cdot \cos(azSCC) + Be \cdot \sin(dipe) \cdot \cos(inc)$$

wherein Be and dipe are theoretical values of the earth's magnetic field strength and dip angle respectively, and azSCC is the azimuth, as calculated by the short collar correction method.

The method may further comprise the step of correcting Bx and By for biases, and may further comprise the step of calculating Bt and dip. Preferably Bt is calculated using:

$$Bt = \sqrt{(Bx^2 + By^2 + Bz_c^2)}$$

Preferably dip is calculated using:

$$dip = \tan^{-1}\left(\frac{Bv}{Bn}\right)$$

The method may further comprises calculating the value of Δdip. Preferably Δdip is calculated using:

$$\Delta dip = dipe - dip$$

wherein Δdip is the dip angle bias, and dipe and dip are theoretical values of the earth's dip angle and the tool measured dip angle respectively.

Preferably the method further comprises the step of minimising Δdip by modifying the magnetometer measurements $Bx_m$ and $By_m$ by a shielding factor S. The step of minimising Δdip preferably comprises varying S according to the following algorithms:

$$Bx_c = \frac{Bx_m}{1-S} \quad By = \frac{By_m}{1-S}$$

Accordingly the present invention is capable of calculating the magnetometer scale factor errors, thereby overcoming or minimising the effects of magnetic mud or other magnetic materials which exert an effect upon the magnetometers of an MWD system downhole.

A theoretical example will now be described, with reference now made to the accompanying figures, in which.

This section examines the accuracy of the two embodiments of the invention used to determine the presence of magnetic shielding.

The first embodiment calculates axial magnetic interference and the individual cross axial biases and scale factor errors by minimising the difference between IFR/IIFR data and tool measured data.

The second embodiment uses an extension of the SCC algorithms to determine a single cross axial scaling error. It assumes that the Bx and By magnetometers have identical scale factor errors and constrains the SCC dip and $B_{total}$ (Bt) to equal the IFR/IIFR data. This technique has the advantage that data from fewer survey stations are required. However this method can be sensitive to cross axial biases if there is less data or there is insufficient highside variation. Again the accuracy of this technique relies on IFR, or ideally IIFR, data being available.

Figure 1:
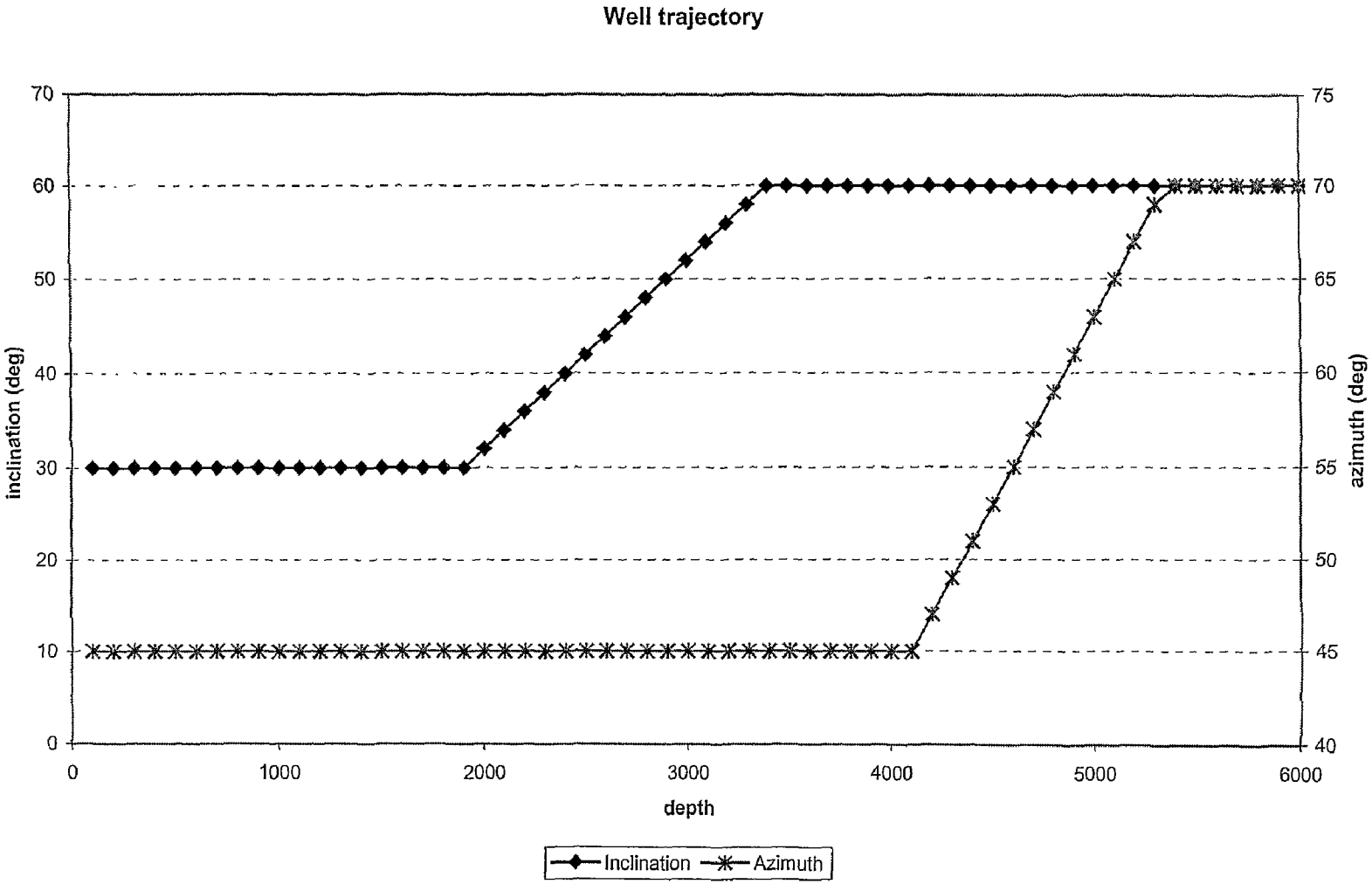
FIG. 1 is a chart depicting the assumed well trajectory (azimuth and inclination) of a theoretical model for a North Sea location.

A theoretical example will now be described. In this theoretical example a North Sea location was assumed, together with magnetometer biases of 140 nT, −80 nT and 2000 nT on $B_x$, $B_y$ and $B_z$ respectively. A cross axial magnetic shielding value of 2% was modelled. Random noise of +/−0.5 milli g and +/−50 nT was added to the accelerometer and magnetometer outputs respectively. The assumed well trajectory in shown in FIG. 1.

The following error values were calculated:

| | Calculated error | |
|---|---|---|
| Error source | mean | Std. dev. |
| $\Delta B_x$ (nT) | 131 | 12 |
| $\Delta B_y$ (nT) | −85 | 21 |
| $\Delta B_z$ (nT) | 1997 | 35 |
| $S_x$ (%) | −2.048 | 0.152 |
| $S_y$ (%) | −2.065 | 0.183 |
| $S_{xy}$ (%) | −1.962 | 0.382 |

Note that the calculated value of $S_{xy}$ is slightly less accurate and noisier. This is a consequence of the cross axial biases affecting the accuracy of the extended SCC technique. However the accuracy of $S_{xy}$ could be improved by correcting for the cross axial biases.

Figure 2:
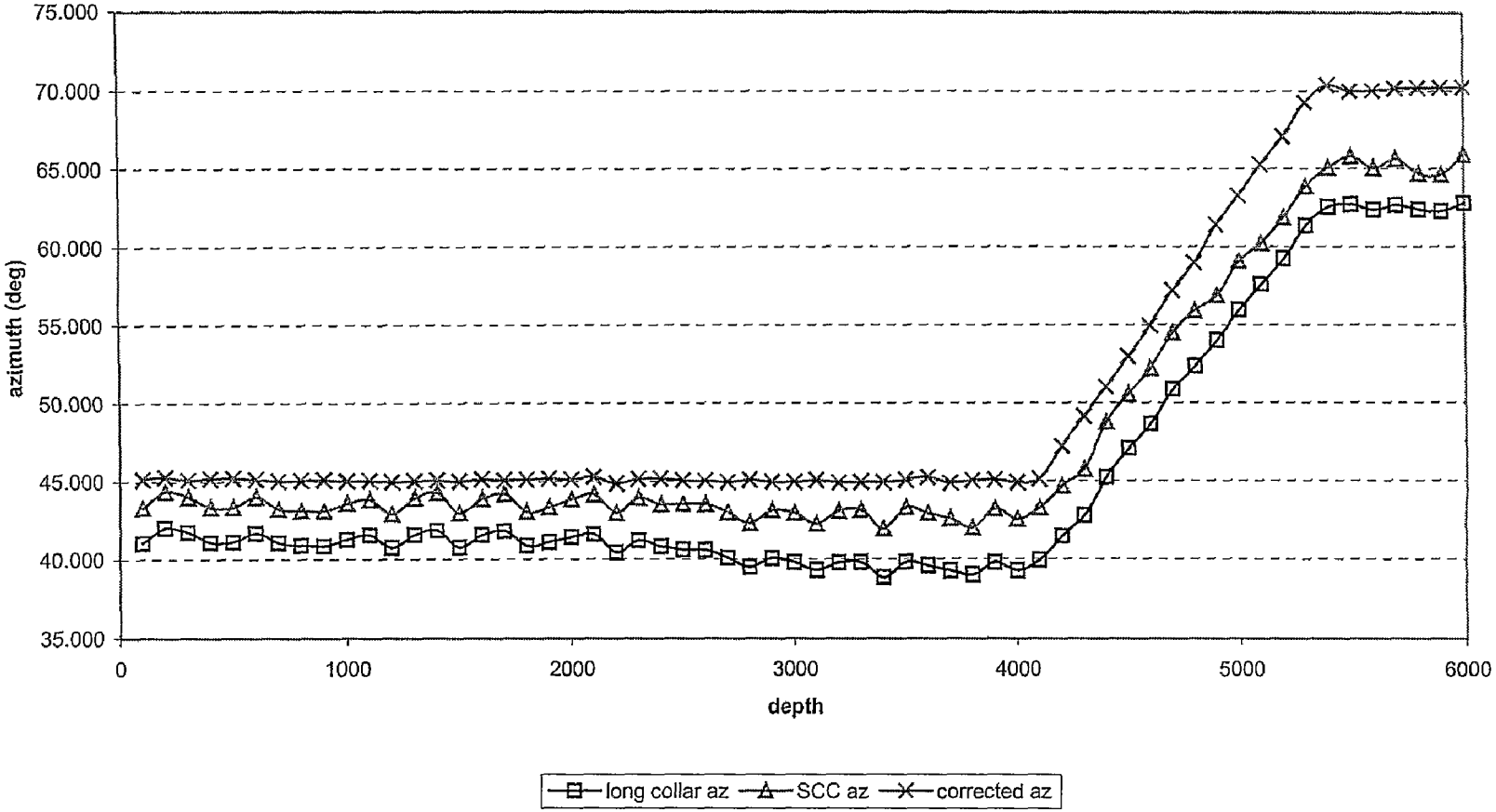
FIG. 2 is a chart depicting the raw (long and short) azimuths and the azimuth corrected by the method of the present invention.
Figure 3:
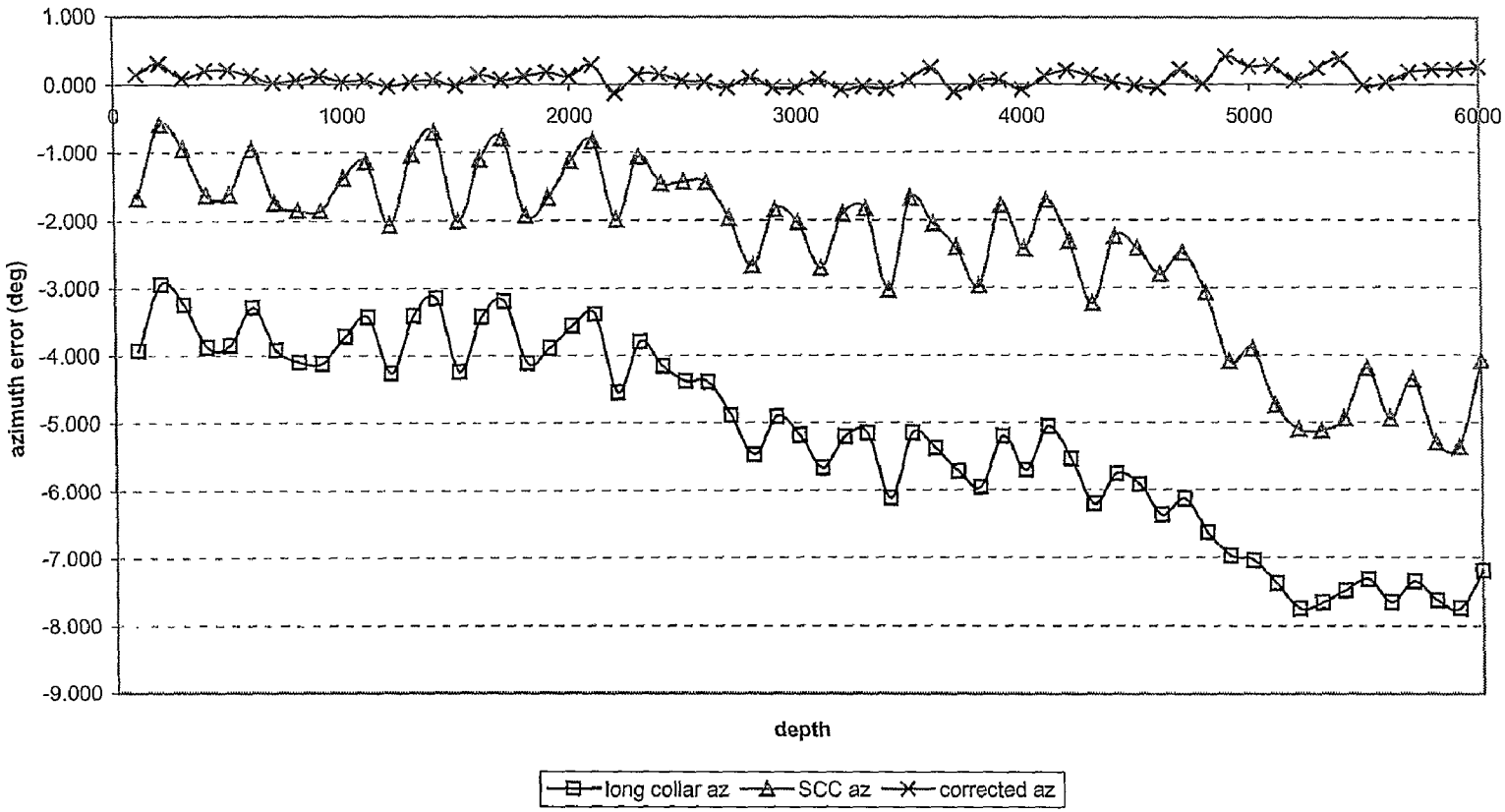
FIG. 3 is a chart comparing the long and short collar azimuth errors.

The raw (long and short collar) azimuths and the corrected azimuth are shown in FIG. 2. The azimuth error is illustrated in FIG. 3.

It will be appreciated that the invention can be modified.

The invention claimed is:

1. A method for surveying a wellbore comprising:

obtaining theoretical data regarding field strength and dip angle of the earth's magnetic field in the proximity of the wellbore;

drilling a wellbore with a drilling string, the drill string comprising a measuring-while-drilling (MWD) tool with at least one set of magnetometers and at least one set of accelerometers;

measuring data regarding the field strength and dip angle of the earth's magnetic field in the proximity of the wellbore from at least one position from within the wellbore using the at least one set of magnetometers and the at least one set of accelerometers positioned in the wellbore;

determining the presence of magnetic shielding effects of mud within the wellbore based on the measured data and the theoretical data; and applying a correction to the measured data to correct readings obtained by the MWD tool for the shielding effect of the mud.

2. The method according to claim 1, further comprising calculating the highside angle and the inclination angle.

3. The method according to claim 2, wherein the highside angle is calculating from the accelerometer output using the following algorithm:

$$hsg = \tan^{-1}\left(\frac{gy}{-gx}\right)$$

wherein: hsg is the highside angle, and gx and gy are the accelerometer outputs on the x and y axis respectively.

4. The method according to claim 2, wherein the inclination angle is calculated from the accelerometer output using the following algorithm:

$$inc = \tan^{-1}\left(\frac{(gx^2+gy^2)^{0.5}}{gz}\right)$$

wherein: inc is the highside angle, and gx , gy and gz are the accelerometer outputs on the x, y and z axes respectively.

5. The method according to claim 1, further comprising obtaining accelerometer output and magnetometer output measurements from at least 5 stations in the wellbore.

6. The method according to claim 5, wherein said magnetometer output measurements comprise $Bx_m$, $By_m$, and $Bz_m$ wherein: $Bx_m$, $By_m$, and $Bz_m$ are the output measurement values of the downhole magnetometer set used for wellbore surveying in the x, y, and z axes respectively.

7. The method according to claim 6, further comprising:

correcting the measured magnetometer outputs $Bx_m$, $By_m$ and $Bz_m$ for magnetic interference/biases and shielding effects of the mud using the following algorithms:

$$Bx_c = \frac{Bx_m}{1-Sx} + \Delta Bx$$

$$By_c = \frac{By_m}{1-Sy} + \Delta By$$

$$Bz_c = Bz_m + \Delta Bz$$

wherein: $Bx_c$, $By_c$ and $Bz_c$ are magnetometer outputs corrected for biases and scaling errors, Bx, ΔBy and ΔBz are the magnetometer biases on the x, y and z axes respectively, and Sx, Sy are the magnetometer scaling errors on the x and y axes respectively.

8. The method according to claim 7, further comprising: calculating the measured dip angle using the vertical and horizontal components of the earth's field using the following algorithms:

$$Bv=-Bx_c\cdot\cos(hsg)\cdot\sin(inc)+By_c\cdot\sin(hsg)\cdot\sin(inc)+Bz_c\cdot\cos(inc)$$

$$Bn=\sqrt{(Bx_c^2+BY_c^2+Bz_c^2)^{1/2}-Bv^2}$$

$$dip=\tan^{-1}\left(\frac{Bv}{Bn}\right)$$

wherein: Bv is the vertical component of the earth's magnetic field;

Bn is the horizontal component of the earth's magnetic field;

dip is the tool measured dip angle.

9. The method according to claim 8, further comprising calculating the total magnetic field, Bt.

10. The method according to claim 9, wherein Bt is calculated using the following algorithm:

$$Bt=\sqrt{(Bx^2+By^2+Bz^2)}$$

wherein: $B_x$, $B_y$, and $B_z$ are the components of the magnetic field in the x, y, and z axes respectively.

11. The method according to claim 9, further comprising using the calculated values of Bt and dip to minimise S , wherein Bt and dip are as hereinbefore defined.

12. The method according to claim 11, wherein using the calculated values of Bt and dip to minimise S comprises inputting Be, Bt, dipe and dip in the following algorithm:

$$S=\sum_n\left[\left(\frac{Be-Bt}{Be}\right)^2+\left(\frac{dipe-dip}{dipe}\right)^2\right]$$

where: Be and dipe are theoretical values of the earth's magnetic field strength and dip angle respectively, and Bt and dip are as hereinbefore difined, and varying Sx, Sy, ΔBx, ΔBy and ΔBz in order to minimise S.

13. The method according to claim 1, further comprising obtaining accelerometer output and magnetometer output measurements from 10 stations in the wellbore.

14. The method according to claim 1, wherein each set of magnetometers comprises three magnetometers, and each set of accelerometers comprises three accelerometers.

15. The method according to claim 1, further comprising obtaining accelerometer output and magnetometer output measurements from at least 1 position in the wellbore.

16. The method according to claim 15, further comprising calculating Azimuth (azACC) by the short collar correction method.

17. The method according to claim 16, further comprising calculating $Bz_c$, wherein $Bz_c$ is as hereinbefore defined.

18. The method according to claim 17, wherein $Bz_c$ is calculated using:

$$Bz_c=Be\cdot\cos(dipe)\cdot\sin(inc)\cdot\cos(azSCC)+Be\cdot\sin(dipe)\cdot\cos(inc)$$

wherein: Be and dipe are theoretical values of the earth's magnetic field strength and dip angle respectively, and azSCC is the azimuth, calculated by the short collar correction method.

19. The method according to claim 17, further comprising correcting Bx and By for bias errors, wherein Bx and By are as hereinbefore defined.

20. The method according to claim 17, further comprising calculating Bt and dip as hereinbefore defined.

21. The method according to claim 20, wherein Bt is calculated using the following algorithm:

$$Bt=\sqrt{(Bx^2+By^2+Bz_c^2)}$$

22. The method according to claim 20, wherein dip is calculated using the following algorithm:

$$dip=\tan^{-1}\left(\frac{Bv}{Bn}\right)$$

wherein dip, Bv, and Bn are as hereinbefore defined.

23. The method according to claim 20, further comprising calculating the value of Δdip , wherein Δdip is the dip angle bias.

24. The method according to claim 23, wherein Δdip is calculated using:

$$\Delta dip=dipe-dip$$

wherein: Δdip is the dip angle bias, and dipe and dip are theoretical values of the earth's dip angle and the tool measured dip angle respectively.

25. The method according to claim 23, further comprising minimising Δdip by modifying the magnetometer measurements $Bx_m$ and $By_m$ by a shielding factor S.

26. The method according to claim 25, wherein minimising Δdip comprises varying S according to the following algorithms:

$$Bx_c=\frac{By_m}{1-S}\quad By=\frac{By_m}{1-S}$$

27. The method according to claim 1, wherein the theoretical data regarding the earth's magnetic field is obtained from a location remote from the wellbore.

28. The method according to claim 1, wherein the theoretical data regarding the earth's magnetic field is obtained by in-field referencing or interpolated in-field referencing.

29. The method according to claim 1, further comprising: correcting said measurement data for the effects of magnetic interference, including correcting for magnetometer biases and magnetometer scale factor errors.

30. The method according to claim 29 wherein said correcting for the effects of magnetic interference comprises iteratively modeling sensitivity of error sources to determine bias and scale factor corrections, and applying said bias and scale factor corrections.

* * * * *